US008522375B2

(12) United States Patent
Conrad et al.

(10) Patent No.: US 8,522,375 B2
(45) Date of Patent: Sep. 3, 2013

(54) BED SIDE SLEEPER FOR INFANTS

(75) Inventors: Derek Conrad, Ontario, CA (US); Douglas Tharalson, Agoura, CA (US); Diana Tharalson, Agoura, CA (US); Denny Tsai, Ontario, CA (US)

(73) Assignee: Baby Trend Inc., Ontario, CA (US)

( * ) Notice: Subject to any disclaimer, the term of this patent is extended or adjusted under 35 U.S.C. 154(b) by 416 days.

(21) Appl. No.: 12/741,825

(22) PCT Filed: Oct. 9, 2008

(86) PCT No.: PCT/US2008/079430

§ 371 (c)(1), (2), (4) Date: Jul. 31, 2010

(87) PCT Pub. No.: WO2009/049102

PCT Pub. Date: Apr. 16, 2009

(65) Prior Publication Data

US 2012/0266380 A1 Oct. 25, 2012

Related U.S. Application Data

(60) Provisional application No. 60/978,732, filed on Oct. 9, 2007.

(51) Int. Cl.
*A47D 7/00* (2006.01)

(52) U.S. Cl.
USPC ..... 5/93.1; 5/98.1

(58) Field of Classification Search
USPC ..... 5/93.1, 97, 98.1, 99.1
See application file for complete search history.

(56) References Cited

U.S. PATENT DOCUMENTS

| | | | | |
|---|---|---|---|---|
| 2,553,087 | A | 5/1951 | Hanson | |
| 3,311,934 | A | 4/1967 | Goldberg | |
| 4,882,799 | A * | 11/1989 | Shapiro | 5/100 |
| D366,978 | S * | 2/1996 | Mariol | D6/491 |
| 5,553,336 | A | 9/1996 | Mariol | |
| 5,615,427 | A * | 4/1997 | Huang | 5/99.1 |
| 5,845,349 | A | 12/1998 | Tharalson et al. | |
| 5,991,944 | A * | 11/1999 | Yang | 5/99.1 |
| 7,055,191 | B1 | 6/2006 | Chen | |
| 7,458,114 | B2 * | 12/2008 | Troutman | 5/93.1 |
| 2003/0177575 | A1 | 9/2003 | Cheng | |
| 2006/0253978 | A1 | 11/2006 | Paesang | |

FOREIGN PATENT DOCUMENTS

| | | |
|---|---|---|
| DE | 200 12 793 | 11/2000 |
| JP | S36-30078 | 11/1961 |
| JP | S53-142486 | 10/1978 |
| JP | 2000-116470 | 4/2000 |
| JP | 3125693 | 9/2006 |

OTHER PUBLICATIONS

International Search Report and Written Opinion in counterpart PCT application No. PCT/US08/079430, dated Dec. 5, 2008.

(Continued)

*Primary Examiner* — Fredrick Conley
(74) *Attorney, Agent, or Firm* — Chen Yoshimura LLP

(57) ABSTRACT

A sleeper for infants is described. The sleeper has four short legs, a frame supported by the legs and a bassinette hanging from the frame. The sleeper can rest on its legs for use in a stand-alone state, or be mounted on a playard for use as a bedside sleeper. When mounted on a playard, the sleeping surface of the sleeper has approximately the same height as an adult's bed.

15 Claims, 8 Drawing Sheets

(56) References Cited

OTHER PUBLICATIONS

European Extended Search Report in a counterpart application EP 08 83 7995, dated Sep. 20, 2012.

Chinese Office Action, dated Nov. 9, 2011, in a counterpart Chinese patent application, No. CN 200880110793.5.

Japanese Office Action, dated Mar. 19 2013, in a counterpart Japanese patent application, No. JP 2010-529061.

* cited by examiner

BED SIDE SLEEPER FOR INFANTS

This application claims priority from U.S. Provisional Patent Application Ser. No. 60/978,732 filed Oct. 9, 2007, which is herein incorporated by reference in its entirety.

BACKGROUND OF THE INVENTION

1. Field of the Invention

This invention relates to a sleeper for infants, and in particular, it relates to a bedside sleeper for infants.

2. Description of the Related Art

Some conventional playards are equipped with a removable infant sleeper in the form of a bassinet hanging from the top frame of the playard. Such sleepers, however, cannot be used in a stand-alone mode. In addition, the sleepers are typically about 12 inches deep, and the level of the sleeping surface is typically lower than an adult's bed.

SUMMARY OF THE INVENTION

The present invention is directed to a sleeper for infant. An object of the present invention is to provide a sleeper that can be used either as a stand-alone sleeper or mounted on a support structure to form a bedside sleeper.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a sleeper for infants, which includes: at least four legs; at least four joining blocks each mounted at a top end of one of the legs; four side rail bars connected to the joining blocks to form a frame; and a plurality of webbings attached to at least two of the four side rail bars to form a bassinette, wherein a depth of the bassinette is less than a length of the legs. The four joining blocks each include a hook for mounting the sleeper on a support structure (a playard). The frame is about 24×27 inches in size; the bassinette is about 4 inches deep and the legs are about 5 inches long.

In another aspect, the present invention provides a sleeper system for infants, which includes: a sleeper including a support frame and a bassinette attached to and suspended from the support frame, the support frame having a depth greater than a depth of the bassinette; and a support structure having a top frame, wherein the sleeper is removably mounted on and suspended from the top frame of the support structure.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
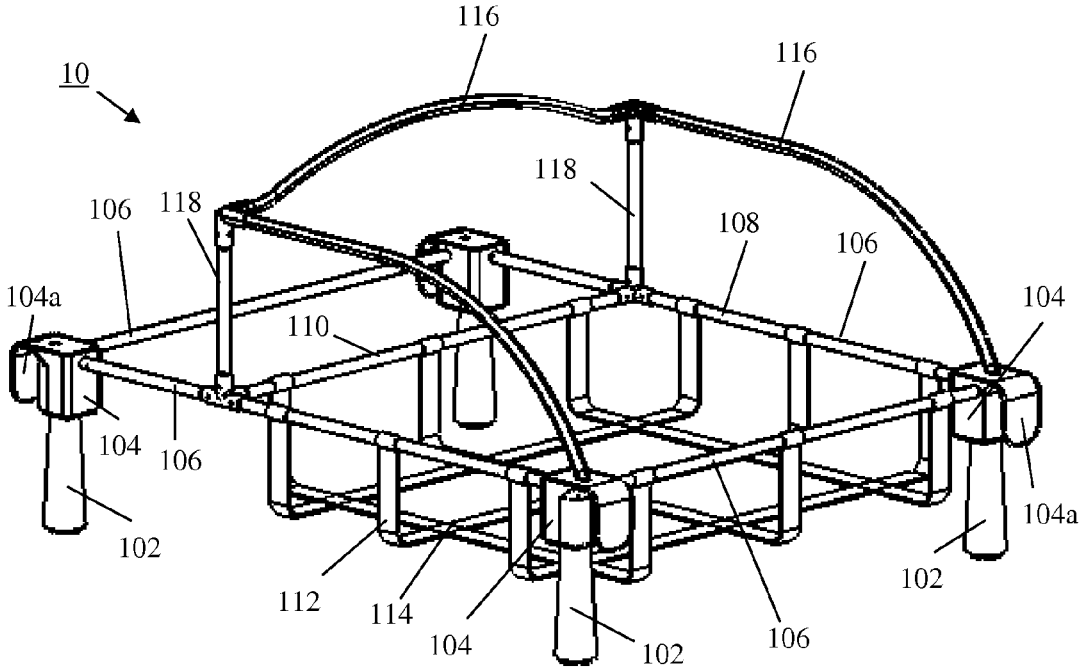
FIGS. 1-4 are perspective, front, left side and bottom views, respectively, of the sleeper in a stand-alone state according to an embodiment of the present invention.
Figure 2:
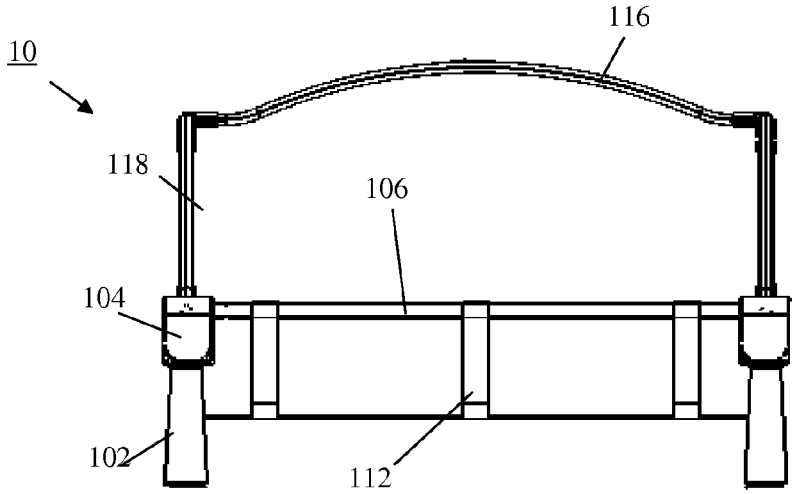
Figure 3:
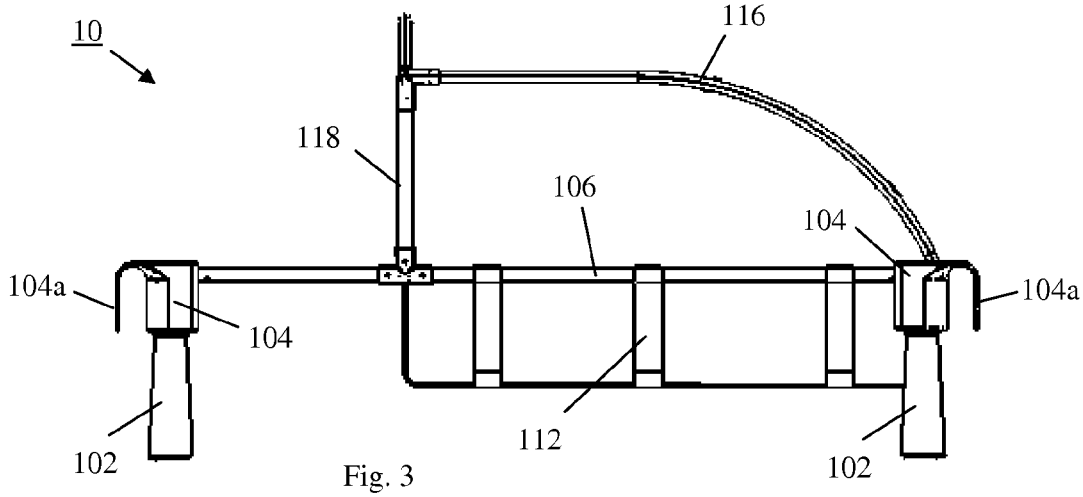
Figure 4:
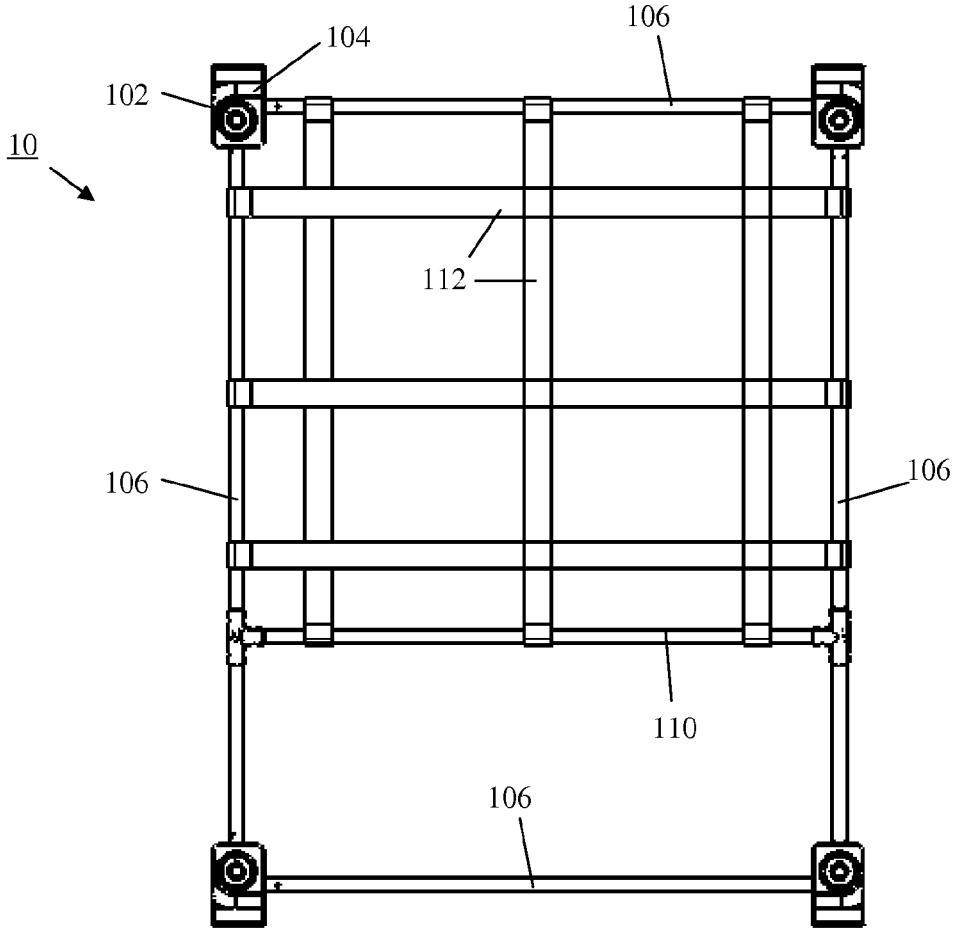

Embodiments of the present invention provide a sleeper for infants, such as infants from newborn to six months of age. The sleeper can be mounted on a support structure so that it has approximately the same height as a bed. This configuration can accommodate new mothers who wish to have their infants sleep beside them at night. FIGS. 6-9 show the sleeper mounted on a support structure. The support structure may be connected to the bed with the sleeper resting on the support structure. The sleeper is also removable for use in a stand-alone state, as shown in FIGS. 1-4.

As shown in FIGS. 1-4, the sleeper 10 has four short legs 102 with a joining block 104 mounted at the top of each leg. In a preferred embodiment, the legs 102 are approximately 5 inches long. Four side rail bars 106 are connected to the joining blocks 104 to form a frame 108. In one embodiment, the joining blocks 104 have holes on the bottom and two sides, and the legs 102 and two side rail bars 106 are inserted into the holes. The frame 108 is preferably approximately 24×27 inches in size. A cross bar 110 is joined to the two longer side rail bars 106. A plurality of webbings 112 are attached to three side rail bars 106 and the cross bar 110 to form a bassinette 114 hanging from the frame 108. In one embodiment, the webbings 112 include two sets of webbings extending perpendicular to each other. The depth of the bassinette 114 is less than the length of the legs 102 so that the sleeper 10 can be used by resting the legs 102 on the floor. In the preferred embodiment, the bassinette 114 is approximately 4 inches deep. Mattress and/or other suitable materials (not shown) are placed inside the bassinette 114.

In the preferred embodiment, the legs 102 and the joining blocks 104 are made of plastic materials, the side rail bars 106 and the cross bar 110 are made of a tubular metal material of about 0.5 inches in diameter, and the webbings 112 are made of nylon. Alternatively, the webbings may be replaced with a mesh or fabric material or other suitable materials to form the bassinette 114.

The sleeper 10 can be disassembled by disconnecting the legs 102 and the side rail bars 106 from the joining blocks 104.

Figure 10:
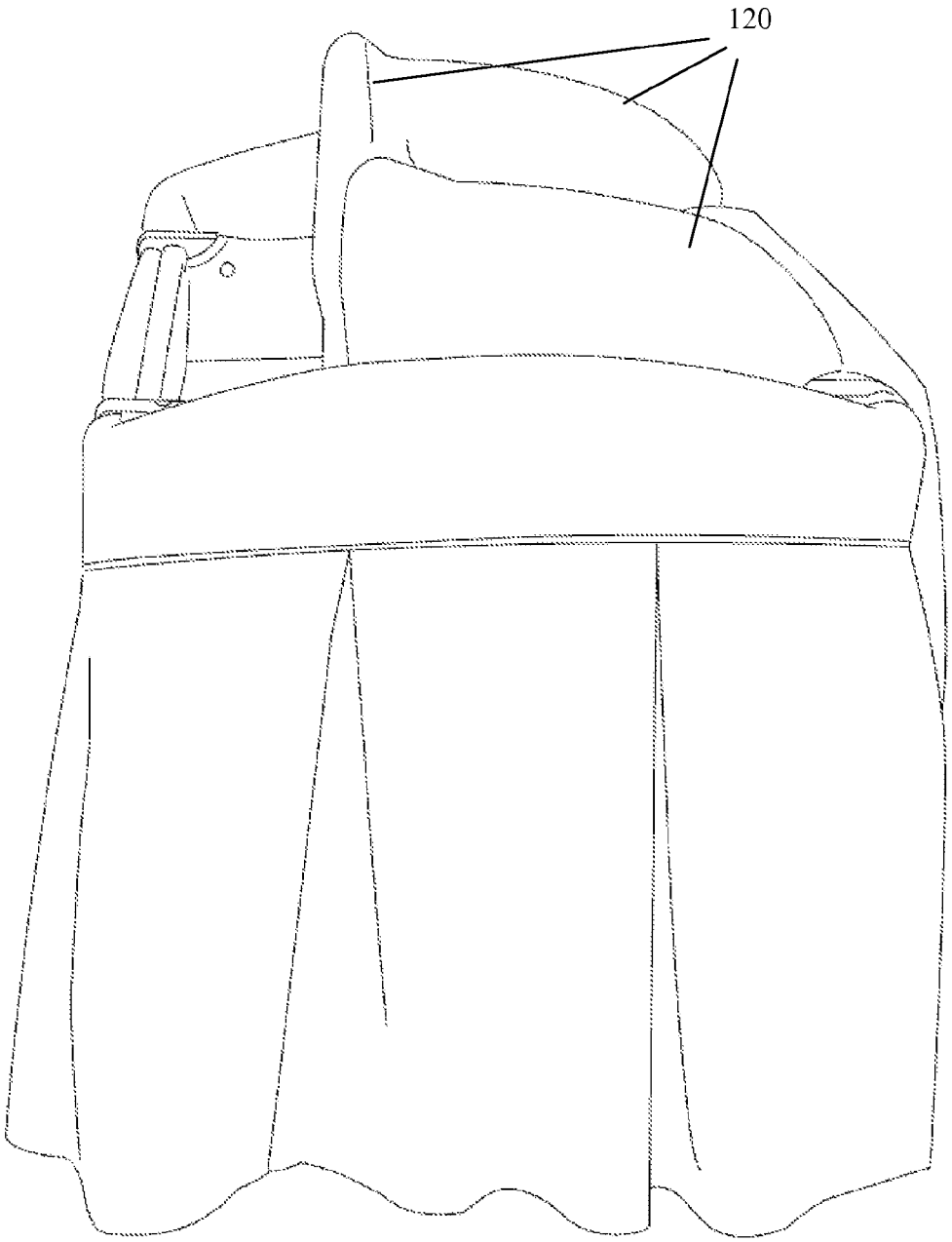
FIG. 10 show the sleeper mounted on the supported structure with a fabric cover.

Optionally, a number of top rails 116 are provided above the frame 108. In the illustrated embodiment, two vertical posts 118 are joined to the two ends of the cross bar 110 and extend above the frame 108, and three curves top rails 116 are supported by the vertical posts and the frame 108. Covers 120 may be placed over the top rails 116 to form raised walls on three sides (rear, left and right) of the sleeper as shown in FIG. 10.

Figure 5:
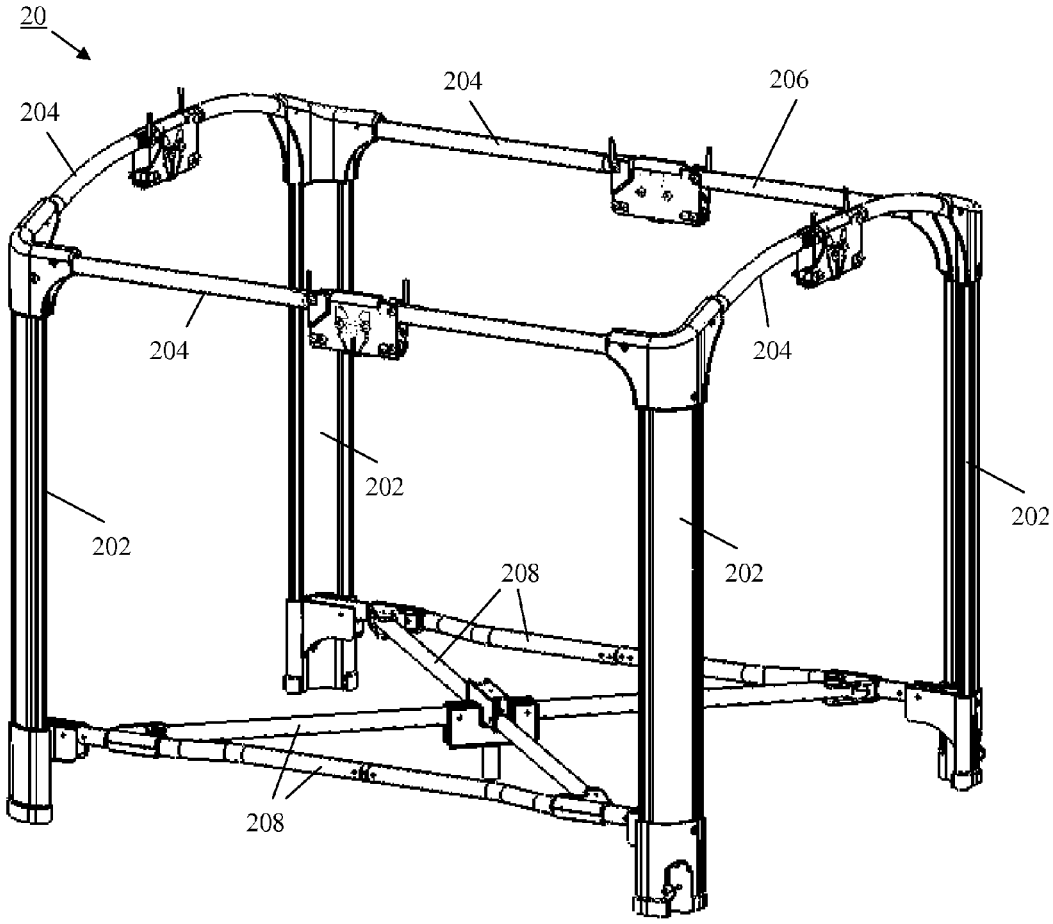
FIG. 5 is a perspective view of a support structure (playard) without the sleeper.
Figure 6:
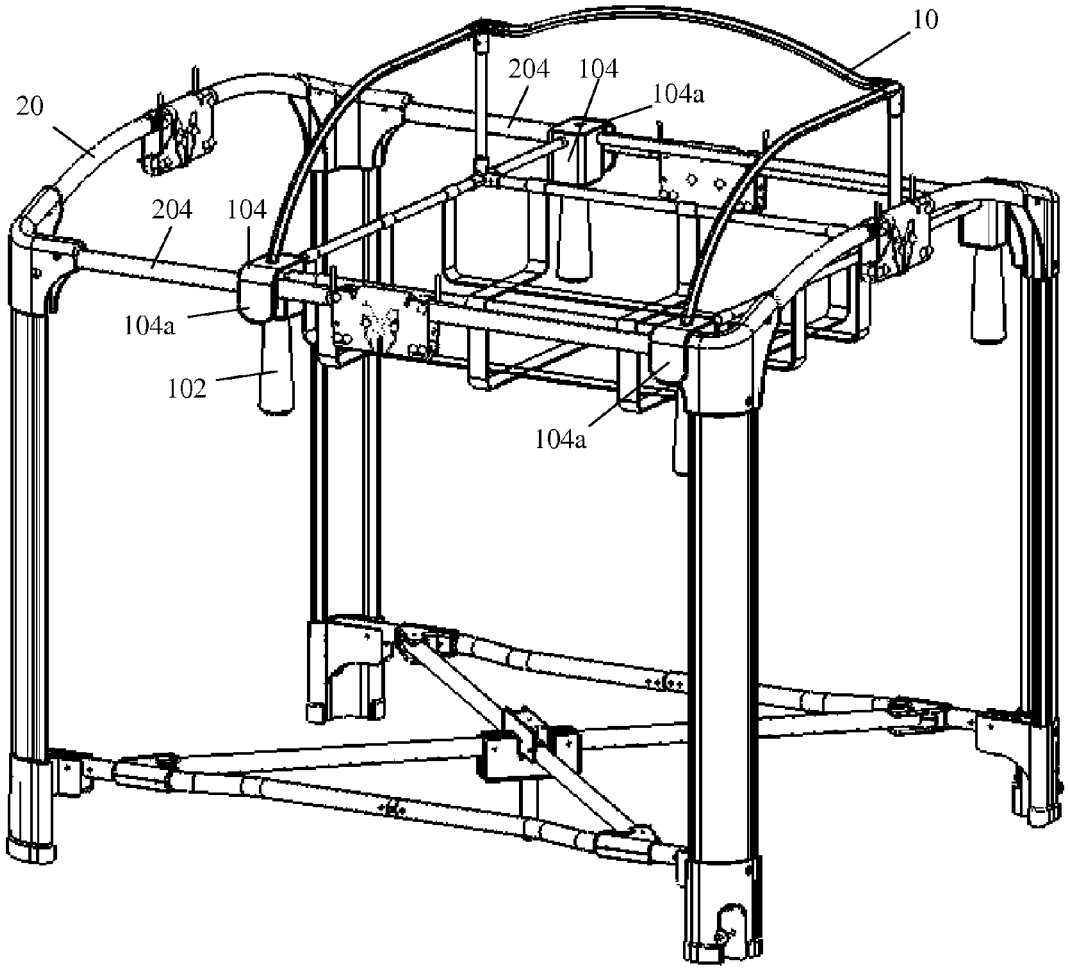
FIGS. 6-9 are perspective, front, left side and top views, respectively, of the sleeper mounted on the support structure according to an embodiment of the present invention.
Figure 7:
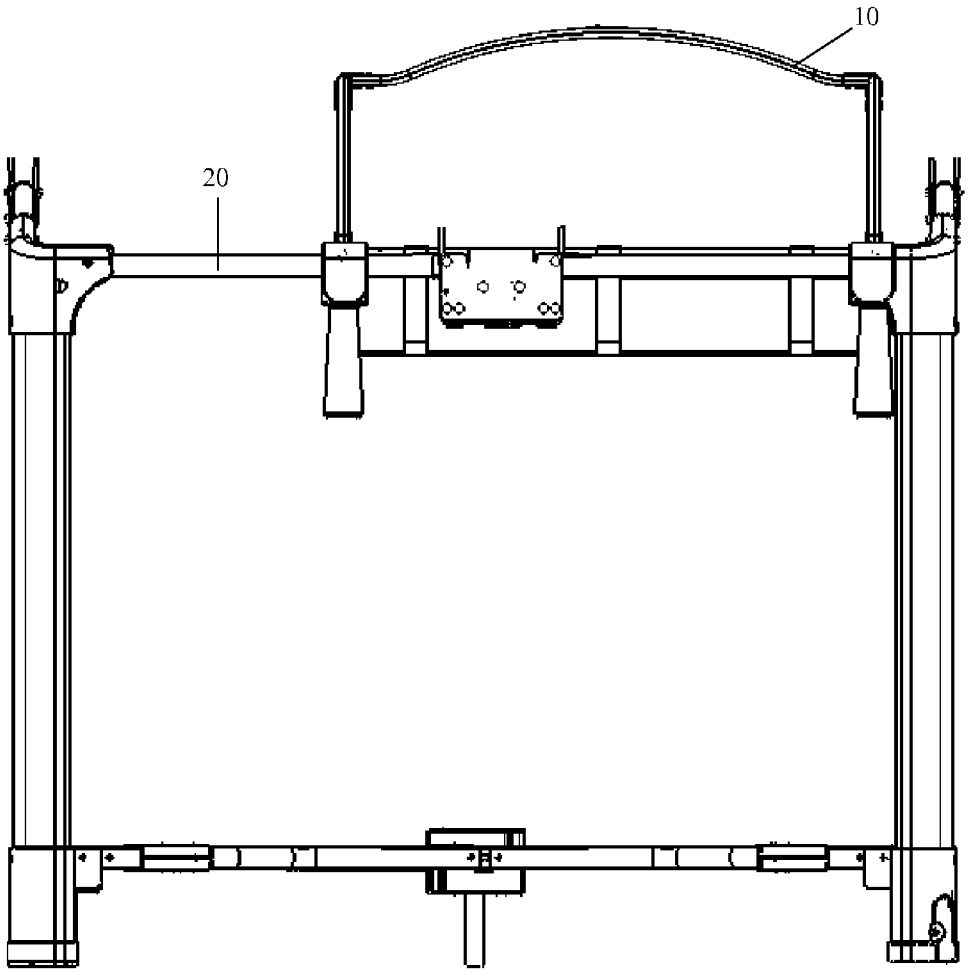
Figure 8:
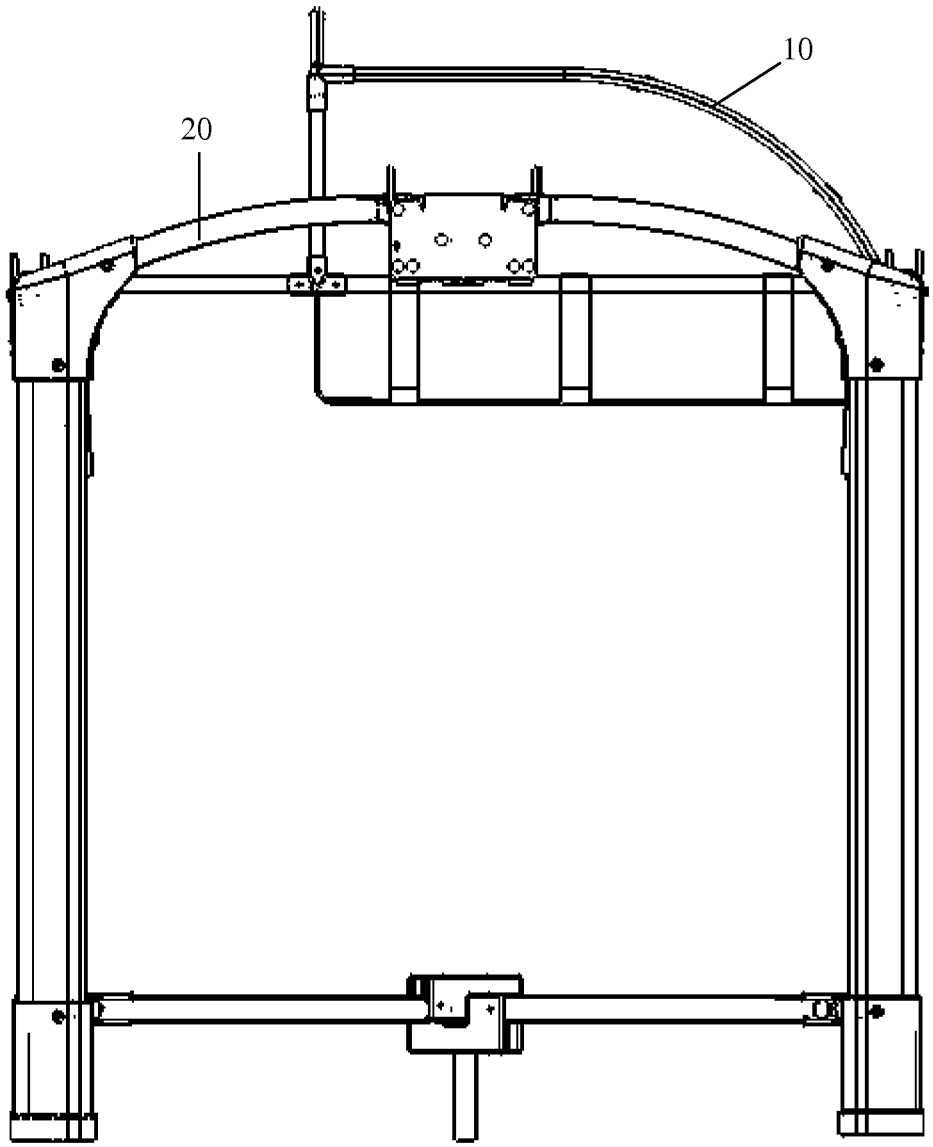
Figure 9:
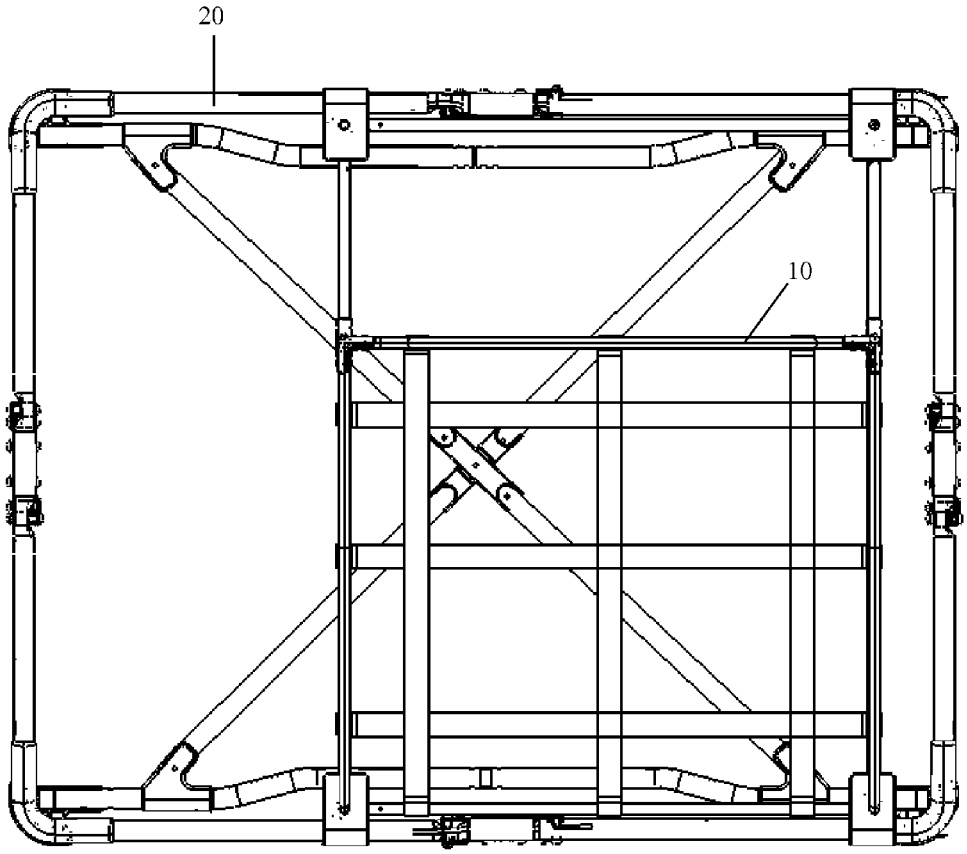

FIG. 5 shows a support structure 20 on which the sleeper 10 may be mounted. In a preferred embodiment, the support structure 20 is a playard/crib. The support structure 20 has four vertical posts 202 and four side rails 204 joined to the top ends of the posts 202 to form a top frame 206. In the preferred embodiment, the top frame 206 is approximately 28 inches from the ground. A number of cross bars 208 are joined to the vertical posts 202 near their bottom end to form a reinforcing structure. A mesh or fabric material (not shown) is attached to the vertical posts 202 and the side rails 204 to form a floor and four side walls of the playard. A mattress and/or other suitable material (not shown) may be placed on the floor of the playard.

FIGS. 6-9 show the sleeper 10 mounted on the support structure 20. In the preferred embodiment, each joining block 104 of the sleeper 10 has a hook 104*a* formed on it to mount the sleeper in the support structure 20 (see also FIGS. 1 and 3). The hooks 104*a* fit over two side rails 204 of the support structure 20 so that the sleeper 10 is suspended from the top frame 206 of the support structure.

The lengths of the side rail bars 106 and the cross bar 110 of the sleeper 10, and hence the size of the bassinette 114, are design choices. In the preferred embodiment, the length of the longer two of the side rail bars 106, namely 27 inches, is chosen to fit the width of the top frame 206 of the support structure which is a playard. The cross bar 110 is employed because the desired width of the bassinette 114 is less than the width of the top frame 206 of the support structure (playard) 20. In an alternative embodiment, the support structure 20 has the same width as the desired width of the bassinette 114, so the cross bar 110 is not necessary. In this alternative embodiment, the webbings 112 are attached to the four side rail bars 106 of the sleeper 10.

In another alternative embodiment, the webbings 112 are attached to and suspended between two opposite side rail bars 106 and no cross bar is employed. In yet another embodiment, the webbings are attached to three side rail bars 106 and no cross bar is employed.

In an alternative embodiment, the four legs 102 of the sleeper are replaced by a support frame. For example, the support frame may include four vertical posts and four lower horizontal bars joining the four vertical posts at their lower ends, so that the vertical posts, the top side rail bars and the lower horizontal bars form a box shaped frame. The bassinette is less deep than the box shaped frame so the sleeper can be free standing.

The sleeper described above is portable and light weight. It can be easily mounted on or taken off from the support structure. When mounted on the support structure, the bottom of the bassinette is at approximately the same level of a normal bed, so the mother can easily attend to the infant. The sleeper can also be easily taken the off from the support and used as a stand-alone sleeper in another room. Further, the sleeper, without the support structure, can be easily disassembled and carried for use on overnight trips.

It will be apparent to those skilled in the art that various modification and variations can be made in the infant sleeper of the present invention without departing from the spirit or scope of the invention. Thus, it is intended that the present invention cover modifications and variations that come within the scope of the appended claims and their equivalents.

What is claimed is:

1. A sleeper for infants, comprising:

at least four legs;

at least four joining blocks each mounted at a top end of one of the legs, wherein each of the four joining blocks includes a hook;

four side rail bars connected to the joining blocks to form a frame; and a plurality of webbings or a mesh or fabric material attached to at least two of the four side rail bars to form a bassinette, wherein a depth of the bassinette is less than a length of the legs.

2. The sleeper of claim 1, further comprising a plurality of vertical posts joined to and extending above the frame, and a plurality of top rails supported by the vertical posts and the frame.

3. The sleeper of claim 1, further comprising a cross bar joined to and extends between two opposite side rail bars, wherein the plurality of webbings or mesh or fabric material are attached to the two opposite side rail bars, the cross bar, and one of the side rail bars opposite to the cross bar.

4. The sleeper of claim 1, wherein the frame is about 24×27 inches in size.

5. The sleeper of claim 1, wherein the bassinette is about 4 inches deep.

6. The sleeper of claim 5, wherein the legs are about 5 inches long.

7. The sleeper of claim 1, wherein the legs and the joining blocks are made of plastic, the side rail bars are made of a tubular metal material, and the webbings or mesh or fabric material are made of nylon.

8. A sleeper system for infants, comprising:

a sleeper including a support frame and a bassinette attached to and suspended from the support frame, the support frame having at least four legs, at least four joining blocks each mounted at a top end of one of the legs, and four side rail bars connected to the joining blocks, wherein a length of the legs is greater than a depth of the bassinette; and a support structure having a top frame including two pairs of parallel side rails, and four vertical posts supporting the top frame, the four vertical posts being separate from the four legs of the sleeper support frame, wherein the sleeper includes four hooks for fitting over one of the two pairs of the parallel side rails of the top frame of the support structure to removably suspend the sleeper from the parallel side rails of the top frame of the support structure.

9. The sleeper system of claim 8, wherein the legs and the joining blocks are made of plastic, the side rail bars are made of a tubular metal material, and the webbings or mesh or fabric material are made of nylon.

10. The sleeper system of claim 8, wherein the support frame of the sleeper is about 24×27 inches in size and 5 inches deep.

11. The sleeper system of claim 8, wherein the bassinette is about 4 inches deep.

12. The sleeper system of claim 8, wherein the bassinette includes a plurality of webbings or a mesh or fabric material attached to at least two of the four side rail bars.

13. The sleeper system of claim 8, wherein the top frame of the support structure is connected near upper ends of the vertical posts, and wherein the top frame is about 28 inches above lower ends of the vertical posts.

14. The sleeper system of claim 8, wherein the sleeper further comprises a cross bar joined to and extends between two opposite side rail bars, wherein the plurality of webbings or mesh or fabric material are attached to the two opposite side rail bars, the cross bar, and one of the side rail bars opposite to the cross bar.

15. The sleeper system of claim 8, wherein the sleeper further comprises a plurality of vertical posts joined to and extending above the support frame, and a plurality of curved top rails supported by the vertical posts and the support frame.

* * * * *